US005924818A

United States Patent [19]

Holmes

[11] Patent Number: 5,924,818

[45] Date of Patent: Jul. 20, 1999

[54] WEAR RESISTANT SLOPE ADJUSTING ASSEMBLY FOR A SCREED

[75] Inventor: Ted E. Holmes, Mattoon, Ill.

[73] Assignee: Blaw-Knox Construction Equipment Corp., Mattoon, Ill.

[21] Appl. No.: 08/939,145

[22] Filed: Sep. 29, 1997

Related U.S. Application Data

[60] Provisional application No. 60/041,005, Mar. 27, 1997.

[51] Int. Cl.[6] ..... E01C 19/22

[52] U.S. Cl. ..... 404/96; 404/104; 404/118

[58] Field of Search ..... 404/118, 120, 404/104, 96

[56] References Cited

U.S. PATENT DOCUMENTS 4,129,399 12/1978 Ruge ..... 404/104 X
4,986,695 1/1991 Heims ..... 404/104 X
5,203,642 4/1993 Heller et al. ..... 404/96 X
5,725,325 3/1998 Schleiter et al. ..... 404/104 X

*Primary Examiner*—James A. Lisehora
*Attorney, Agent, or Firm*—John J. Selko

[57] ABSTRACT

A wear compensating device for a slope adjusting assembly for an extendable screed section of a paver includes a saddle support assembly on the screed, for supporting an extendable screed section, a saddle assembly on the saddle support assembly for carrying extendable guide members to support the extendable screed section, and an adjustable cam follower positioned between the saddle assembly and the saddle support assembly for providing rolling contact between the saddle assembly and the saddle support assembly, to maintain alignment between the saddle support assembly and the saddle assembly.

4 Claims, 4 Drawing Sheets

WEAR RESISTANT SLOPE ADJUSTING ASSEMBLY FOR A SCREED

This application claims benefit of U.S. Provisional application Ser. No. 60/041,005, filed Mar. 27, 1997.

BACKGROUND OF THE INVENTION

This invention relates generally to a width-extendable portion of a screed, and more particularly to a device that compensates for wear between the major support assemblies of the movable parts of an extendable screed, so that during slope adjustment of asphalt material by the extended screed, integrity of the slope of asphalt being acted upon by the extended portion of screed is maintained.

The past design utilized nonadjustable wear plates between the major support assemblies that moved relative to each other, during the slope adjustment operation. When these wear plates became worn, movement of the major support assemblies with respect to each other resulted in misalignment that caused objectional variations in slope of the asphalt. The extendable portion of the screed had to be partially disassembled to expose the worn wear plates for replacement, a time consuming and expensive proposition.

The foregoing illustrates limitations known to exist in present slope adjusting assemblies for screeds. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

A wear compensating device for a slope adjusting assembly for an extendable screed section of a paver comprising: a saddle support assembly on the screed, for supporting an extendable screed section, the screed section being extendable laterally with respect to a longitudinal axis of a screed; a saddle assembly on the saddle support assembly for carrying extendable guide members to support the screed section, the saddle assembly movable up and down with respect to the saddle support assembly, during slope adjustment; and an adjustable cam follower means positioned between the saddle assembly and the saddle support assembly for providing rolling contact between the saddle assembly and said saddle support assembly.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
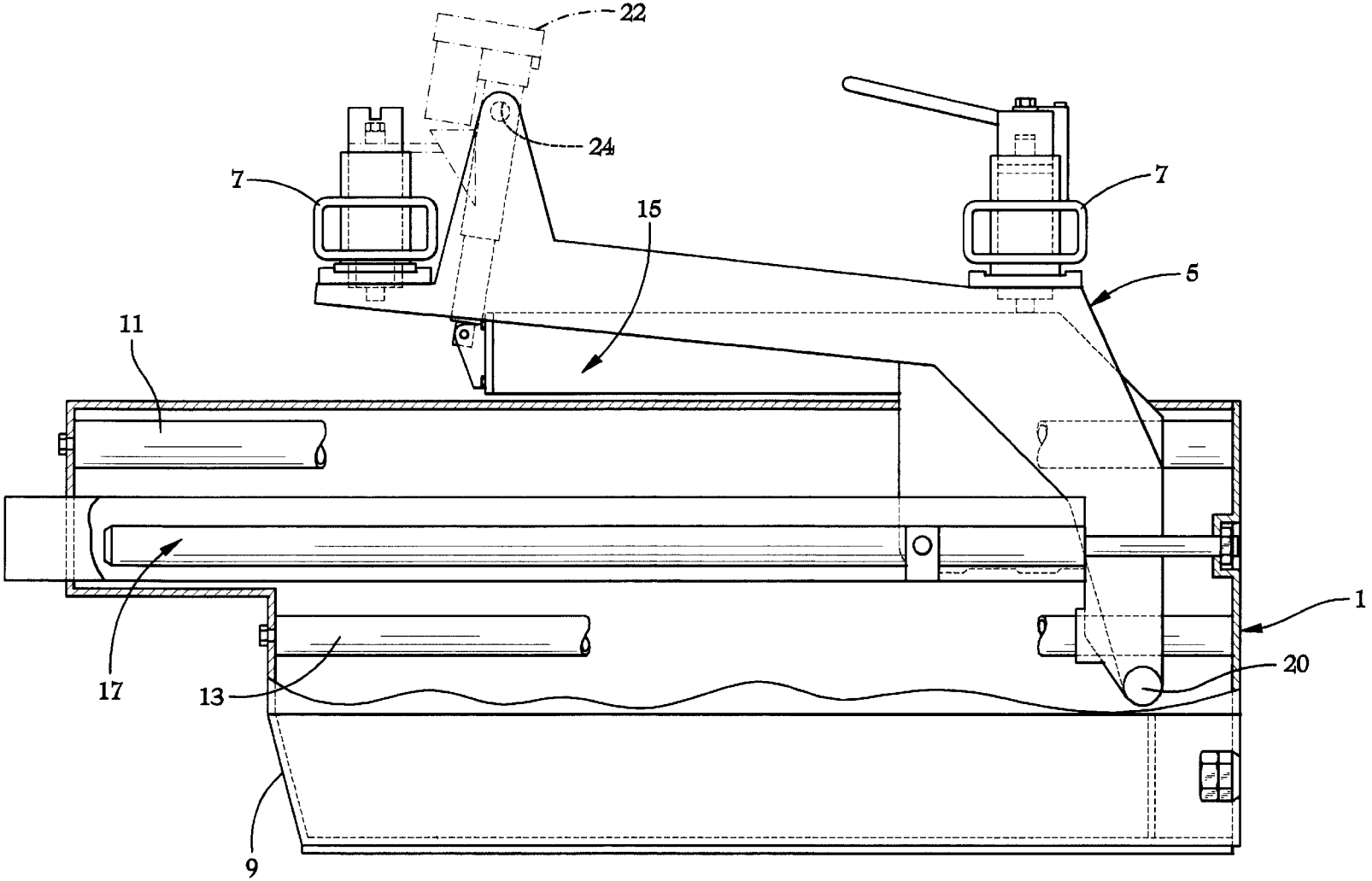
FIG. 1 is a rear elevational schematic view, with parts removed, of an extendable portion of a screed.

FIG. 1 is a rear elevational schematic view, with parts removed, of an extendable portion 1 of a screed utilizing the invention. As is well known, the extendable portion 1 is positioned on each lateral side of the longitudinal centerline of a main screed section (not shown) of a paving machine. Each extendable portion 1 can be positioned in front or in the rear of the main screed section. Each extendable portion 1 using the invention described herein is essentially the same, and description of one will suffice for both.

Extendable portion 1 is carried by a saddle support assembly 5 that is supported by side frame members 7 of the paver chassis. The Saddle support assembly 5 carries the screed body 9 for slidable lateral movement on extendable support guide rails 11, 13 that are carried in a saddle assembly 15. Hydraulic cylinder and piston assembly 17 moves the extendable portion 1 laterally back and forth, as is conventional.

Figure 2:
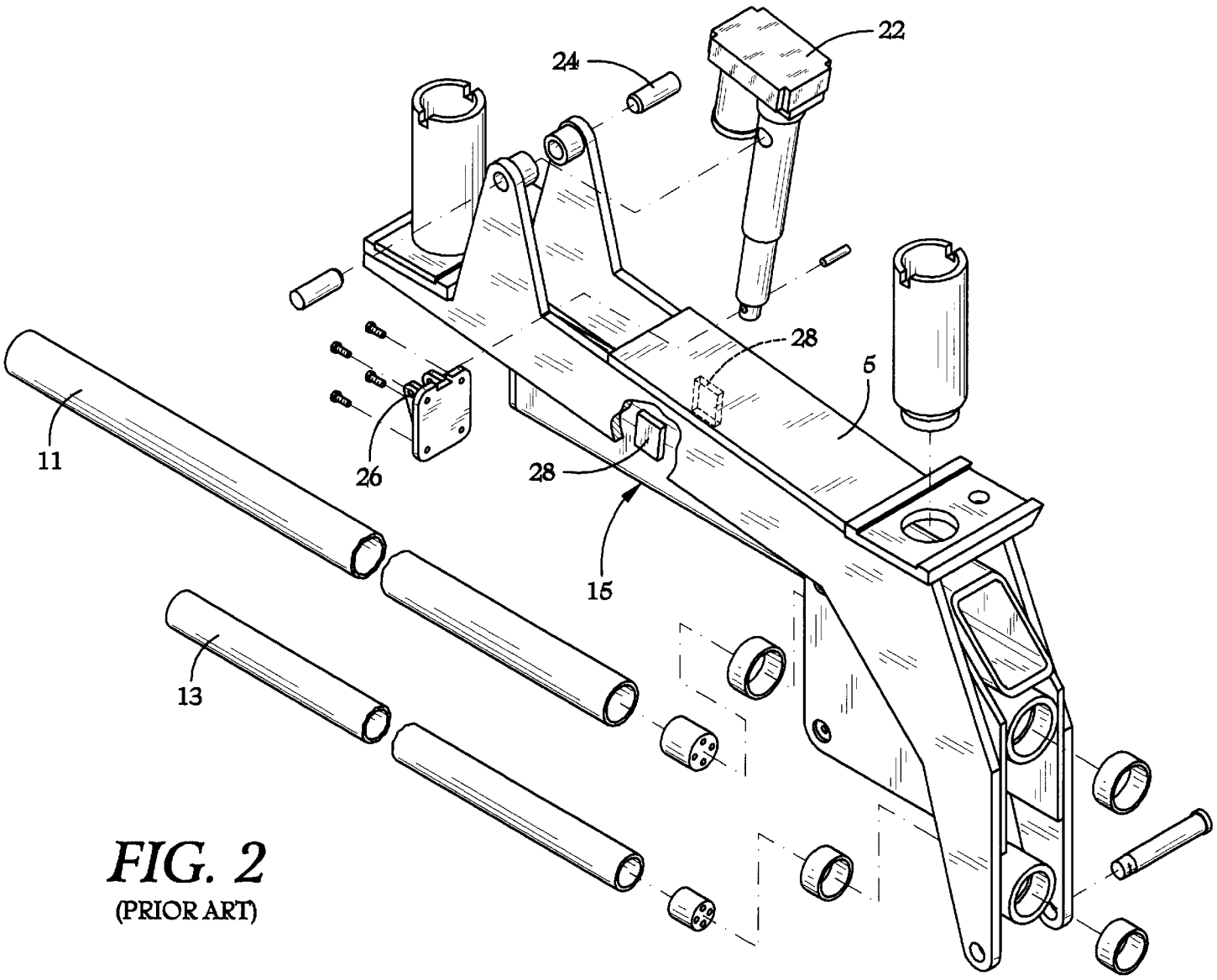
FIG. 2 (PRIOR ART)
FIG. 2 is a perspective, partly cross-sectional exploded view, with parts removed, of the major support assemblies of an extendable portion of a screed.

For slope adjustment, saddle assembly 15 is pivotable up and down about pivot axis 20 located at an outboard side position on saddle support assembly 5. Saddle assembly 15 is moved up and down about pivot axis 20 by conventional linear actuator 22 that is pivotally mounted at a first, upper end 24 on saddle support assembly 5 and at a second, lower end 26 on saddle assembly 15, as is well known. As shown in FIG. 2, the relative movement of saddle assembly 15 and saddle support assembly 5 is slidingly supported by wear plates 28. Over time, wear plates 28 become worn and require replacement. Otherwise, misalignment of saddle support assembly 5 and saddle assembly 15 may cause improper slope.

Figure 3:
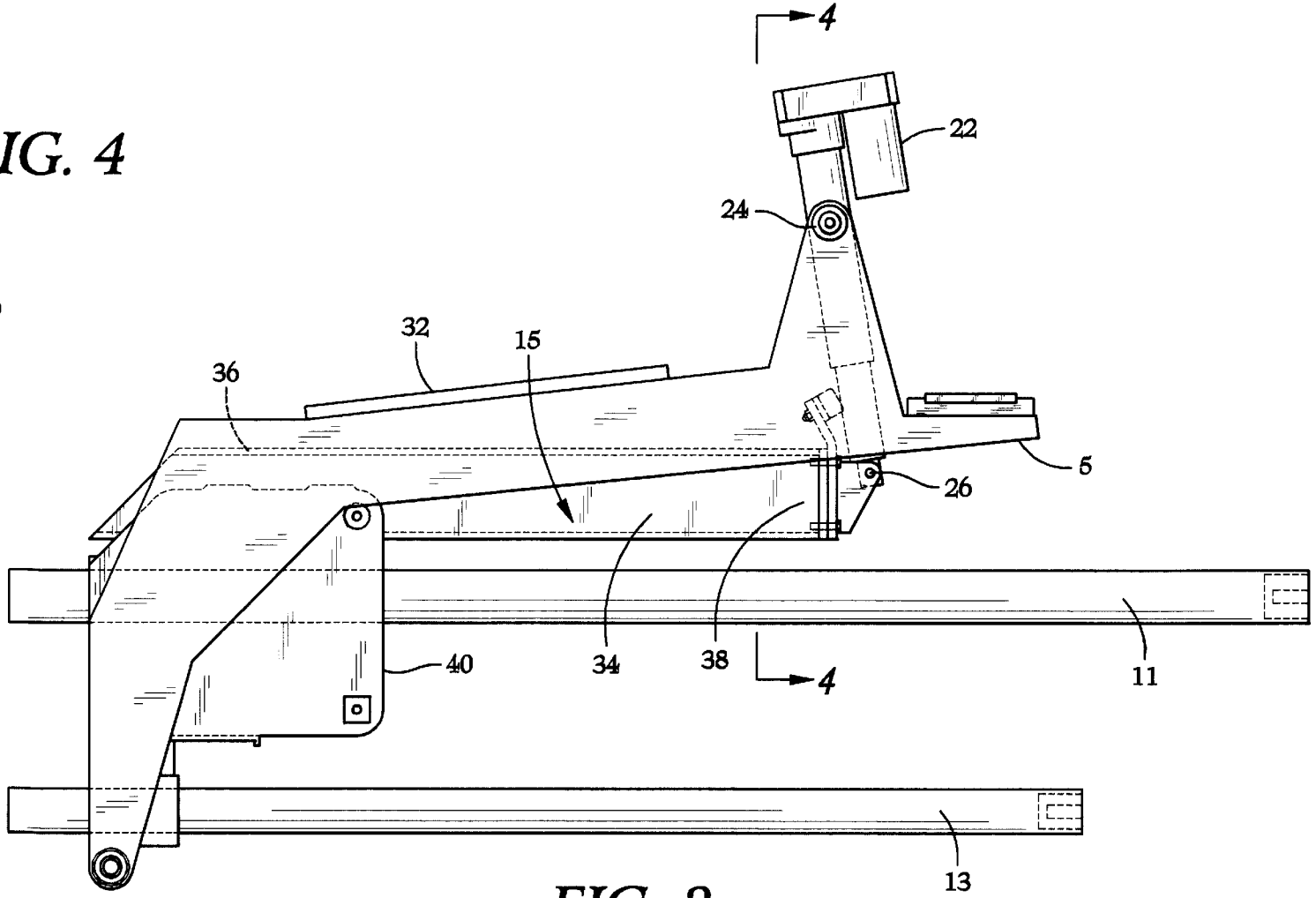
FIG. 3 is a rear elevational schematic view, with parts removed, of the major support assemblies of an extendable portion of a screed utilizing the invention.
Figure 4:
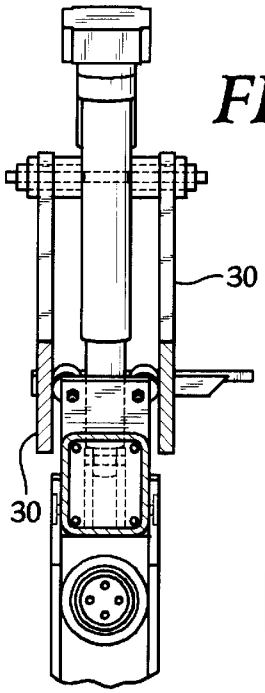
FIG. 4 is a view along 4—4 of FIG. 3.
Figure 5:
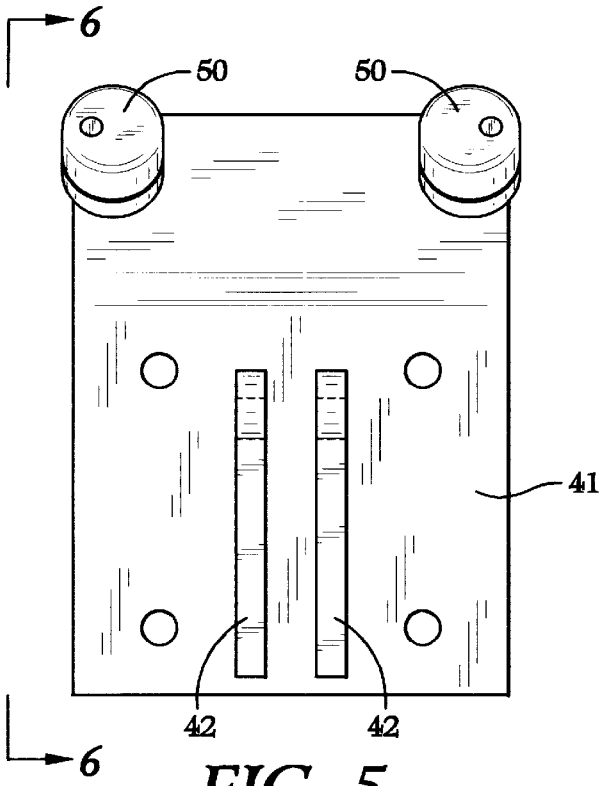
FIG. 5 is a front elevational view of the invention mounted on a support bracket.
Figure 6:
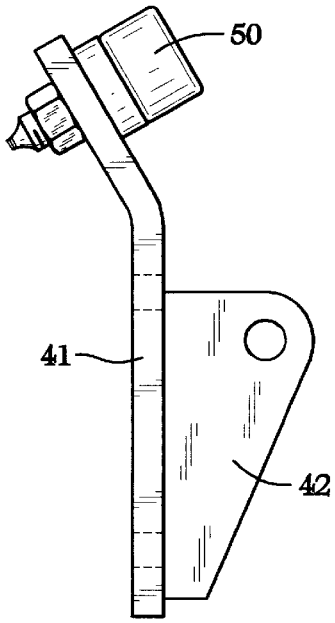
FIG. 6 is a view along 6—6 of FIG. 5.

Now referring to FIGS. 3 and 4, saddle support assembly 5 is shown to be a pair of spaced-apart side plate members 30, connected together by appropriate support members 32. Slidably positioned between side plate members 30 is saddle assembly 15. Saddle assembly further comprises a hollow tubular arm member 34 having a first end 36 and a second end 38. First end 36 carries a support bracket 40 through which extendable support guide rails 11, 13 can slide. Second end 38 carries a support bracket 41 for the cam followers of invention, described hereinafter, and for connecting second end 26 of linear actuator 22 to ears 42 (FIGS. 5 and 6).

A pair of eccentrically adjustable crowned cam followers 50 tracks the inside surfaces of saddle support assembly 5 and saddle assembly 15. By eccentrically adjustable means, the axis of rotation of each cam is off center with respect to its outer circumference. The cam followers 50 are assembled in the narrowest position to ease assembly to the moving elements. After the elements are assembled, the eccentric cam followers 50 are adjusted by rotation to make positive contact with the inner surfaces of saddle support assembly 5 and saddle assembly 15. Wear of the inner surfaces of the saddle support assembly 5 and saddle assembly 15 can be adjusted for by rotating the cam followers 50 to maintain contact.

The invention is retrofittable to previous slope adjusting assemblies.

Having described the invention, what is claimed is:

1. A wear compensating device for a slope adjusting assembly for an extendable screed section of a paver comprising:

(a) a saddle support assembly on said screed, for supporting an extendable screed section, said screed section being extendable laterally with respect to a longitudinal axis of a paver;

(b) a saddle assembly on said saddle support assembly for carrying extendable guide members to support said extendable screed section, said saddle assembly movable up and down with respect to said saddle support assembly, during slope adjustment; and (c) an adjustable cam follower means positioned between said saddle assembly and said saddle support assembly for providing rolling contact between said saddle assembly and said saddle support assembly.

2. The wear compensating device of claim 1 wherein said saddle assembly is pivotable up and down about a pivot axis located at an outboard side position on said saddle support assembly.

3. The wear compensating device of claim 2 wherein said saddle assembly is pivoted up and down for slope adjustment by a linear actuator.

4. The wear compensating device of claim 3 wherein said adjustable cam follower means comprises a pair of spaced-apart, eccentrically adjustable cam followers adjusted to provide rolling contact between said saddle support assembly and said saddle assembly.

* * * * *